United States Patent [19]

Schmitz et al.

[11] 4,432,196

[45] Feb. 21, 1984

[54] TELEPHONE CABLE

[75] Inventors: H.-Joachim Schmitz, Sindorf; Dieter Braun, Berg. Gladbach; Dieter Trodler, Düren; Hugo Cramer, Cologne, all of Fed. Rep. of Germany

[73] Assignee: Felten & Guilleaume Carlswerk Aktiengesellschaft, Cologne, Fed. Rep. of Germany

[21] Appl. No.: 332,360

[22] Filed: Dec. 18, 1981

[30] Foreign Application Priority Data

Mar. 18, 1981 [DE] Fed. Rep. of Germany ..... 3110504

[51] Int. Cl.[3] ..... H01B 13/04; H01B 11/02

[52] U.S. Cl. ..... 57/204; 57/6; 57/293; 174/128 R

[58] Field of Search ..... 57/204, 293, 6, 9; 174/128 R

[56] References Cited

U.S. PATENT DOCUMENTS

| | | | |
|---|---|---|---|
| 2,990,672 | 7/1961 | Demmel | 57/293 |
| 3,194,873 | 7/1965 | Demmel et al. | 57/204 X |
| 3,253,397 | 5/1966 | Gillis | 57/293 X |
| 3,593,509 | 7/1971 | Feese et al. | 57/293 |
| 3,884,025 | 5/1975 | Oberender et al. | 57/293 |

*Primary Examiner*—Donald Watkins

*Attorney, Agent, or Firm*—Michael J. Striker

[57] ABSTRACT

The invention relates to a communications cable which is assembled of at least one basic bundle of at least three component conductors each being formed of two SZ stranded pairs or quads of wires and a portion of the component conductors in the group being radially transposed across each other. The invention also relates to a method of and a device for manufacturing such a cable.

12 Claims, 4 Drawing Figures

TELEPHONE CABLE

BACKGROUND OF THE INVENTION

This invention relates in general to a telephone cable, and in particular to a cable having at least one basic bundle of conductors assembled of at least three component conductors formed respectively of SZ-stranded pairs or quads of wires.

SZ type of stranding means that individual wires are alternately laid clockwise and counterclockwise with twist-free transition zones therebetween. By using the SZ stranding of pairs of quads of wires, a communication cable consisting of one or more basic bundles can be manufactured in a continuous working process starting from individual wires until the completed assembly of basic bundles or a single bundle is provided, if desired, with a protecting jacket. The individual SZ pairs or SZ quads are stranded into the bundle, for example by means of a rotary winder. The assembled pairs or quads of SZ stranded wires in respective basic bundles are laid in such a manner that the transitions from the S-like to the Z-like twist or lay, and vice versa, are shifted in phase relative to each other and/or the individual SZ pairs or quads are stranded with different lengths of lay or twist in order to achieve an improvement of transmission quality of the cable by electrically uncoupling the adjoining strands. It has been found, however, that in prior-art basic bundles of component conductors produced by the above described methods, the capacitive couplings $K_9$ to $K_{12}$ have not been reduced to a sufficient level due to the fact that transition areas in which the wires extend parallel to each other between respective S and Z lays, and vice versa, overlap each other in the individual SZ pairs or quads. To remove this shortcoming, attempts have been made to shorten these interfering parallel areas so that the probability of overlapping be reduced to a minimum. To achieve such short transition zones, however, necessitates the application of costly SZ stranding machines without achieving a really substantial improvement.

SUMMARY OF THE INVENTION

It is therefore a general object of the present invention to overcome the aforementioned disadvantages.

More particularly, it is an object of the invention to provide an improved communications cable of the aforedescribed type, in which the capacitive couplings, particularly the $K_9$ to $K_{12}$ couplings, are sufficiently reduced.

An additional object of the invention is to provide such an improved cable which can be manufactured with relatively inexpensive machines.

In keeping with these objects, and with others which will become apparent hereafter, one feature of the invention resides in the provision of a basic bundle or group of at least three component conductors each including two SZ stranded pair or quads of wires, and the component conductors in the groups being transposed across each other. In a preferred embodiment, the component conductors cross each other at regular intervals, whereby each SZ pair of wires or each SZ quad of wires, during a crossing interval, is shifted once between two opposite adjoining SZ pairs or quads. By virtue of the crossing of the pairs or quads of wires according to this invention, the resulting basic bundle acquires improved electrical coupling quality, particularly in $K_9$ to $K_{12}$ range, the stranding of individual pairs or quads of wires can be dispensed with after the crossing inasmuch as, by the transposition of the stranded wire, a sort of stranding effect is obtained. In this manner, an unexpected advantage is also achieved in the production of the cable, because by combining the SZ stranding of the pairs or quads of wires with their transposition or crossing in a bundle, a new manufacturing device can be employed which is less expensive and more efficient than devices hitherto used for either of the two individual stranding processes. In particular, the rotary winder in conventional SZ stranding devices in the manufacturing method of this invention is replaced by a transposition head in combination with a stationary winder. The slow and bulky machines for pairs of wires in conventional crossing devices are replaced by an SZ part of the novel machine. Accordingly, this invention relates not only to the telephone cable itself, but also to the method of its manufacture and a particular device for carrying out this manufacturing method.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
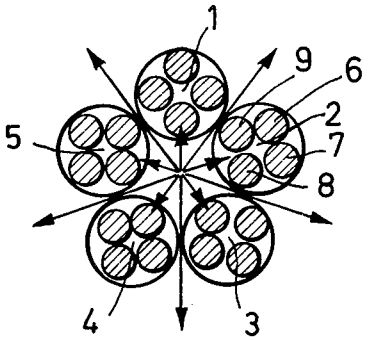
FIG. 1 is a radial cross section of a basic bundle forming the cable of this invention.

Referring firstly to FIG. 1, the communications cable of this invention is assembled of five component conductors 1, 2, 3, 4 and 5 each formed as a stranded quad. The quads consist of four single wires 6–9 stranded together in a SZ pattern. As mentioned before, the SZ stranding pattern means that individual wires in each conductor component are alternately subject to a right-hand twist and to a left-hand twist, whereby a twist-free transition zone is left between respective twists. The five component quad conductors, moreover, are laid into the aforementioned basic group or bundle. As indicated by arrows in FIG. 1, respective quads or component conductors of the cable are subject to transposition or crossing each other so as to periodically change their radial location or position relative to the center axis of the cable. Preferably, the component conductors cross each other at regular intervals in such a manner that each SZ component quad, during a crossing period of interval, is displaced once between two opposite and adjacent component quad conductors. Each double arrow also indicates that respective component quads reassume again their starting position before the next component quad is transposed in a corresponding manner. The crossing period denotes a time interval in which all five component parts are displaced once from their initial position and returned again into this initial position.

Figure 2:
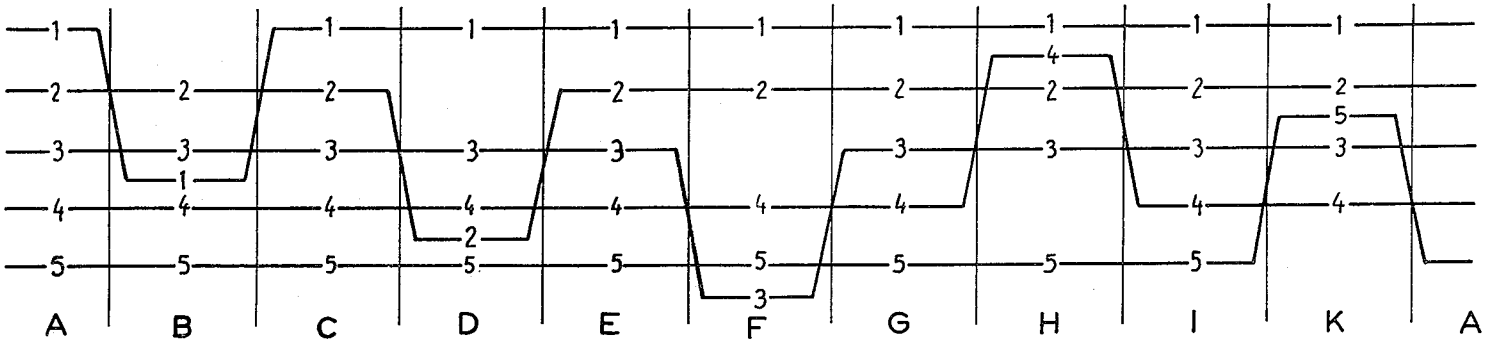
FIG. 2 is a plot showing the course of laying component conductors of a base group in the cable of this invention during one crossing or transposition period.

The transposition or crossing of SZ stranded component quads during a crossing interval is illustrated in the diagram of FIG. 2. The crossing of individual SZ stranded conductor elements has the effect that the capacitive couplings $K_9$ to $K_{12}$ are substantially improved in comparison with similar basic bundles of SZ stranded elements which are not laid with crossings according to this invention but which, according to prior-art methods, are completed by twisting. The cable of this invention has an additional substantial advantage in the face that, due to the crossing of component conductors, the conventional final twisting or stranding of the conductors can be dispensed with. Accordingly, substantial manufacturing improvements can be derived from this fact, as will be explained below in connection with FIG. 3.

Figure 3:
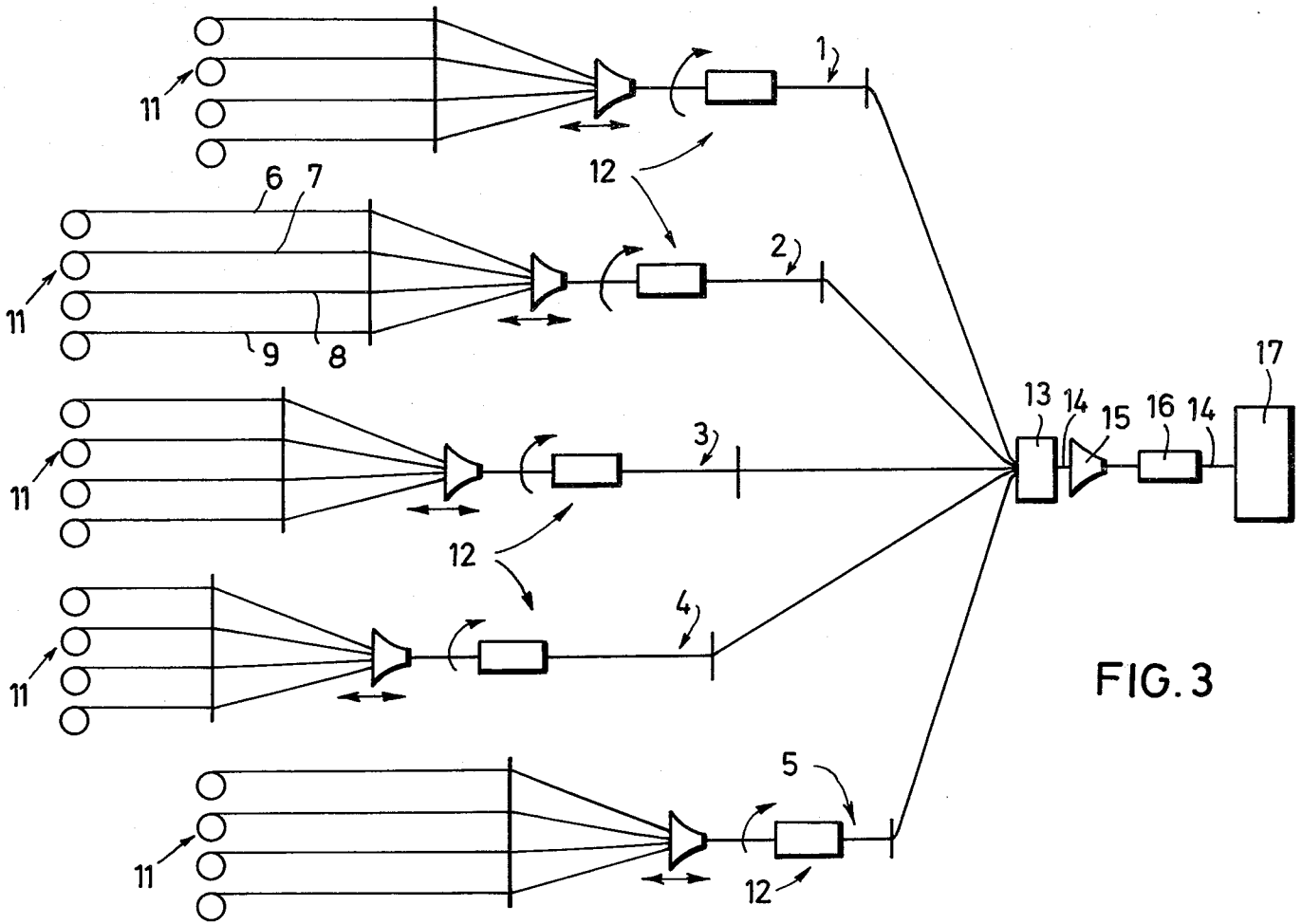
FIG. 3 is a schematic diagram of a device for manufacturing cables of this invention.

FIG. 3 illustrates a principle a manufacturing device for the cable of this invention. The device includes a plurality, in this example five, wire supply stations each having for example four supply reels with individual wires. From the wire supply reels 11 the wires 6–9 of each quad conductor 1–5 are withdrawn and applied to an SZ stranding track 12. These SZ stranding tracks are known for example from the German Pat. No. 21 38 239, so that a detailed description of this known stranding method and device is unnecessary for making and using this invention. It will be pointed out, however, that also other types of known devices and methods for SZ stranding can be employed. After the discharge from the SZ stranding track 12, the stranded quad conductors are applied to a transposing head 13 wherein the transposition or crossing of the individual SZ stranded quads is performed in accordance with the method illustrated in FIG. 2. After the completion of the crossing or transposition in the head 13, the discharged complete basic bundles 14 of the cable can be applied to a twisting nipple 15 and therefrom into a winding device 16 in which the bundle 14 is enveloped in an insulating winding. The winding device 16 may also be followed by a non-illustrated extruder which envelopes the bundle 14 in a protective jacket. Finally, the completed cable is taken up by a stationary winder 17. By virtue of the combined SZ stranding of the quad conductors and the subsequent crossing of the stranded quad conductors over each other, a manufacturing device can be devised which, apart from the aforementioned improved coupling quality of the manufactured cable, enables a substantially improved productivity while the manufacturing costs are substantially lower than in conventional methods for producing basic bundles. Moreover, the manufacturing device of this invention and the novel manufacturing method create a possibility that the basic bundles can be assembled of different conductor elements composed not only of quad conductors but also of pair conductors and the like.

Figure 4:
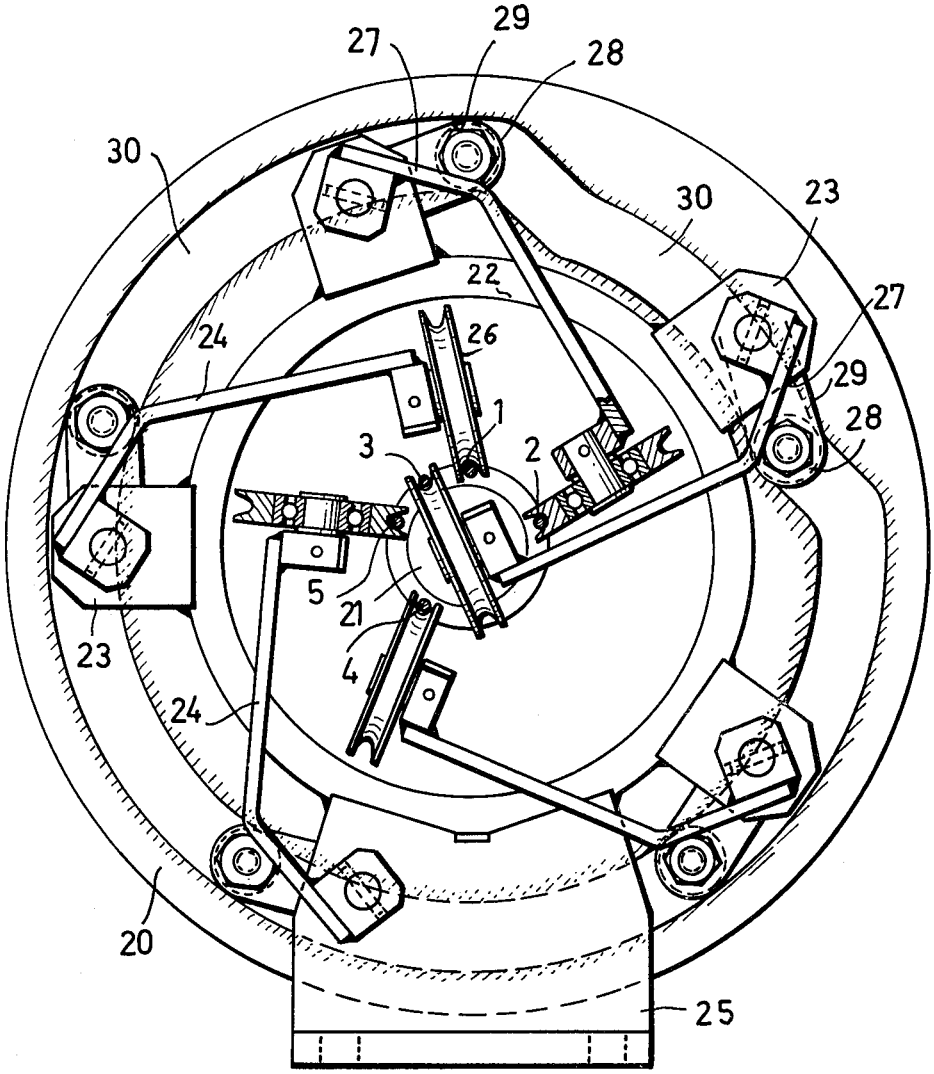
FIG. 4 is a front view of a transposing head in the device of FIG. 3.

Whereas most individual parts of the manufacturing device of this invention, shown by way of example in FIG. 3, are known from prior art, the transposition head 13 has a particular design which may be illustrated in detail in FIG. 4.

The transposition head 13 is constituted by a rotatably supported annular plate 20 formed on its face with an annular cam groove 30 and defining a central opening 21 through which the assembled component conductors 1–5 are discharged. The annular plate 20 is driven by a non-illustrated drive such as a drive gear, or the like. A support ring 22 is concentrically arranged in front of the rotary annular plate 20 in the feeding direction of respective component conductors and is provided on its circumference with bearing blocks 23 which pivotally support arms 24. The supporting ring 24 is fixedly mounted on a stationary base 25 which is fastened by screws on a floor plate, for example. The free end of each arm 24 supports for rotation guiding rollers 26 which are in continuous frictional contact with respective component conductors 1–5 of the cable and in the inactivated position of the assigned arm 24 direct the component conductors parallel to each other into the central opening 21 of the rotary plate 20. The number of the arms 24 corresponds to the number of SZ stranded component conductors in the cable to be manufactured. The capital axle of each arm 24 is connected to a cam roller in the form of a swing arm 29 provided with a cam-following roller 28 which engages the cam groove 30 in the rotary plate 20. A major circumferential sector of the circular cam groove 30 has a larger diameter so that the cam followers 28 and 29 angularly displace the arms 24 into a starting position in which the guiding rollers 26 are directed approximately to the circumference of the central opening 21. A cam sector of the cam groove 30 has a diameter which is reduced about the distance corresponding to a swing of the arm 24 during which the assigned component conductor is crossed or transposed over the central opening 21 between the opposite pair of component conductors. In the example according to FIG. 4, component conductor 3 is illustrated in its transposed position in which it is shifted between component conductors 1 and 5. By rotating the annular plate 20 from the position illustrated in FIG. 4 in clockwise direction, the displaced component conductor 3 is returned into its initial position and the subsequent conductor 4 is shifted by the assigned cam follower 28 and arm 24 between the opposite conductors 1 and 2. Upon a rotary motion about 360° of plate 20, the crossing interval is completed and all five component conductors 1–5 have been successively transposed from their normal position.

The transposing head 13 of this invention is characterized by a very compact structure which makes it possible to arrange the head immediately before the stranding nipple 15. This feature is of particular importance due to the fact that the SZ stranded quad conductors have to be enveloped at the earliest time point to avoid untwisting. This requirement is met to a high degree by the particular arrangement of the device of this invention, and in practice no deviation of the individual SZ stranded quads before their passage through the stranding nipple is necessary, and the enveloping can take place immediately behind the stranding nipple. In practice, the design of the transposing head of this invention enables a combination of this head with the stranding nipple in a single functional unit.

It will be understood that each of the elements described above, or two or more together, may also find a useful application in other types of constructions differing from the types described above.

While the invention has been illustrated and described as embodied in a specific example of telephone cable, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A telephone cable having a center axis and comprising at least one basic group of conductors assembled of at least three component conductors, each component conductor including at least two SZ stranded pairs or quads of wires, and portions of the component conductors in said group being radially transposed across each other so as to periodically change their radial position relative to the center axis of the cable.

2. A cable as defined in claim 1, wherein said component conductors cross each other at regular intervals.

3. A cable as defined in claim 2, wherein a portion of each component conductor in the group is shifted once during each interval between the adjacent opposite conductors.

4. A cable as defined in claim 3, wherein said group includes five component conductors each being assembled of two pairs or quads of SZ stranded wires.

5. A method of manufacturing a telephone cable including at least one basic group of at least three component conductors assembled respectively of stranded wires, comprising the steps of feeding simultaneously the individual wires from supply reels to as many stranding stations as there are component conductors assembled in the cable, laying in each stranding station the wires by a SZ stranding process into respective component conductors, and feeding simultaneously the component conductors into a transposing station where the basic group of component conductors is assembled by radially transposing portions of the component conductors across each other.

6. A method as defined in claim 5, wherein said transposing station crosses said component conductors at regular intervals.

7. A method as defined in claim 6, wherein during a predetermined interval all component conductors are crossed with each other in such a manner that a part of one conductor is shifted between opposite adjacent conductors, whereupon the one conductor is returned into its original position while a part of the subsequent conductor is shifted between opposite conductors.

8. A device for producing a telephone cable assembled of at least one basic group of conductors assembled of at least three component conductors of which each is formed of two pairs or quads of SZ stranded wires, comprising stationary wire supply stations each containing as many wire supply reels as there are stranded pairs or quads contained in the component conductors, SZ stranding stations assigned to respective supply stations for producing the component conductors, a transposing head for arranging the component conductors from respective stranding stations into a basic bundle centered about a center axis and for periodically crossing portions of said component conductors in radial direction relative to said center axis, and a stranding member adjoining the output of the transposing head.

9. A device for producing a telephone cable assembled of at least one basic group of conductors assembled of at least three component conductors of which each is formed of two pairs or quads of SZ stranded wires, comprising stationary wire supply stations each containing as many wire supply reels as there are stranded pairs or quads contained in the component conductors, SZ stranding stations assigned to respective supply stations for producing the component conductors, a transposing head for crossing the component conductors from respective stranding stations into a basic bundle, and a stranding member adjoining the output of the transposing head, said transposing head including a rotary annular plate formed at one face thereof with a circular cam groove and defining a central opening for passing through the assembled component conductors, a stationary bearing ring arranged concentrically in front of said face of the annular plate, a plurality of swing arms mounted on the periphery of the support ring and each supporting at its free end for rotation a guiding ring for an assigned component conductor, and cam followers connected to the swing arms and engaging said cam groove to displace during one cycle one of said arms into a position in which the guiding component conductor is shifted between opposite conductors.

10. A device as defined in claim 9, wherein the supporting ring is provided with bearing blocks for supporting for rotation said arms, said cam followers being in the form of swing levers pivotably supported in said bearing blocks and each having at its free end a follower roller engaging with said cam groove.

11. A device as defined in claim 10, wherein said arms are engageable with said cam followers.

12. A device as defined in claim 9, wherein the number of said arms corresponds to the number of component conductors to be transposed.

* * * * *